United States Patent [19]

Theiler, Sr.

[11] 4,225,990

[45] Oct. 7, 1980

[54] CRIMPING TOOL FOR AUTOMOTIVE IGNITION TERMINALS AND THE LIKE

[75] Inventor: Werner C. Theiler, Sr., Dix Hills, N.Y.

[73] Assignee: Minnesota Mining and Manufacturing Company, Saint Paul, Minn.

[21] Appl. No.: 951,491

[22] Filed: Oct. 16, 1978

[51] Int. Cl.[3] ..... B25B 7/22

[52] U.S. Cl. ..... 7/107; 81/9.5 B; 30/90.1; 140/106

[58] Field of Search ..... 7/107; 81/9.5 B; 30/90.1, 142, 176, 197, 226; 140/106

[56] References Cited

U.S. PATENT DOCUMENTS

| | | | |
|---|---|---|---|
| 3,525,107 | 8/1970 | Hays | 7/107 |
| 3,795,023 | 3/1974 | Miragliotta | 30/90.1 X |
| 3,947,905 | 4/1976 | Neff | 7/107 |
| 4,028,756 | 6/1977 | Couto | 7/107 |

*Primary Examiner*—James G. Smith

*Attorney, Agent, or Firm*—Cruzan Alexander; Donald M. Sell; Terryl K. Qualey

[57] ABSTRACT

A plier type crimping tool including a cut-off edge and complementary anvil, insulation stripping knife edges, terminal leg partial inturning formations, terminal leg full crimping formations, and high tower terminal crimping formations.

16 Claims, 13 Drawing Figures

FIG. 10
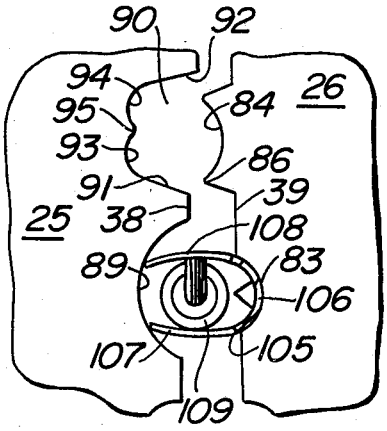
FIG. 11
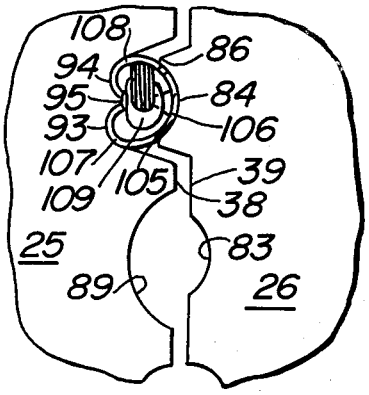
FIG. 13
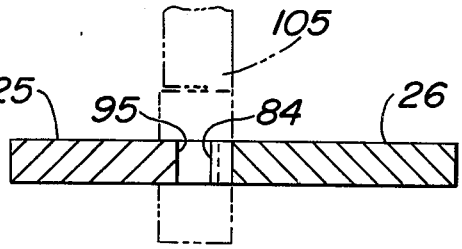
FIG. 12
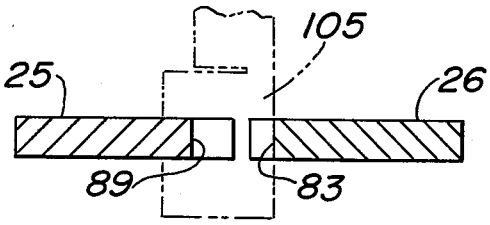
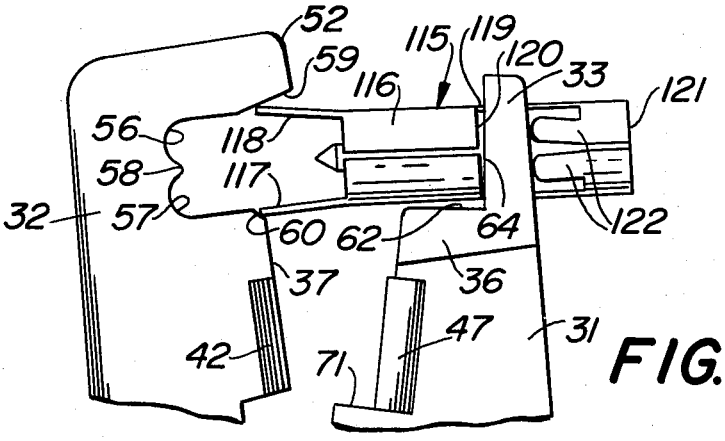
FIG. 4

CRIMPING TOOL FOR AUTOMOTIVE IGNITION TERMINALS AND THE LIKE

BACKGROUND OF THE INVENTION

While there have been proposed, in the prior art, a wide variety of pliers type terminal crimping tools for use in various fields, prior devices have not been entirely satisfactory for use in crimping automotive ignition terminals. For example, automotive ignition wires may be of different sizes, requiring different prior art type crimping tools to achieve satisfactorily crimped terminals. Also, prior ignition terminal crimping devices did not satisfactorily provide for the crimping of high tower terminals to ignition wires, and lacked convenience in wire location for cutting, as well as insulation stripping and terminal crimping. Other difficulties in prior art crimping tools included the need for many, relatively expensive machining operations, the need for high dexterity in use of the prior tools, and relatively frequent damage to ignition wires and both mechanically and electrically inadequate wire termination.

SUMMARY OF THE INVENTION

In accordance with the teachings of the present invention, it is an important object to provide a terminal crimping tool for automotive ignition wire terminals which is capable of performing all the necessary wire cutting, wire stripping and terminal crimping operations for various sizes, shapes and types of wire and terminals in simple and expeditious manner to assure entirely satisfactory electrical and mechanical wire termination.

It is another object of the present invention to provide a wire terminal crimping tool having the advantageous characteristics mentioned in the preceding paragraph, which is capable of effecting(gonsiderable savings in manufacturing costs, while enhancing ease of operation and quality of wire termination, and permitting of sale at a reasonable price.

It is a more particular object of the present invention to provide a wire terminal crimping tool of the type described which includes superior wire cut-off and insulation stripping structures cooperating with each other by adjacent location and flush surfaces to result in simplified operation, manufacturing economy and improved wire product.

It is still a further object of the present invention to provide a high tower terminal crimping station advantageously located adjacent to and outward of the cut-off and stripping locations to effect maximum utilization of tool space and material and requires minimum of metal working operations in manufacture of the tool.

Another object of the present invention resides in the provision of partial and full crimping stations which cooperate with each to permit of relatively quick and easy stage-wise terminal crimping to reduce required operator strength and fatigue, while assuring a more accurately crimped terminal.

The instant invention further contemplates the provision of plural final crimping stations each precisely sized and configured for accurately crimping terminals about respective wire sizes, which final crimping stations are all operatively associated with a single initial crimping station for a relatively simple partial terminal crimping operation at a minimum of manufacturing cost and tool expense.

Further contemplated by the instant invention is the provision of improved insulation stripping formations which more easily receive and properly locate a wire to be stripped, and more positively assure insulation stripping without nicking the conductor or otherwise damaging the wire.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 4 is a partial side view showing a high tower crimping station in an early stage of operation.

FIG. 10 is a partial side view illustrating an initial terminal forming operation.

FIG. 11 is a partial side view similar to FIG. 10, illustrating a later terminal crimping procedure.

FIG. 12 is a transverse sectional view taken generally along the line 12—12 of FIG. 1, and illustrating in phantom an initial terminal leg inturning procedure.

FIG. 13 is a transverse sectional view taken generally along the line 13—13 and showing in phantom a later terminal crimping operation, as in FIG/ 11.

DESCRIPTION OF THE PREFERRED EMBODIMENT

Figure 1:
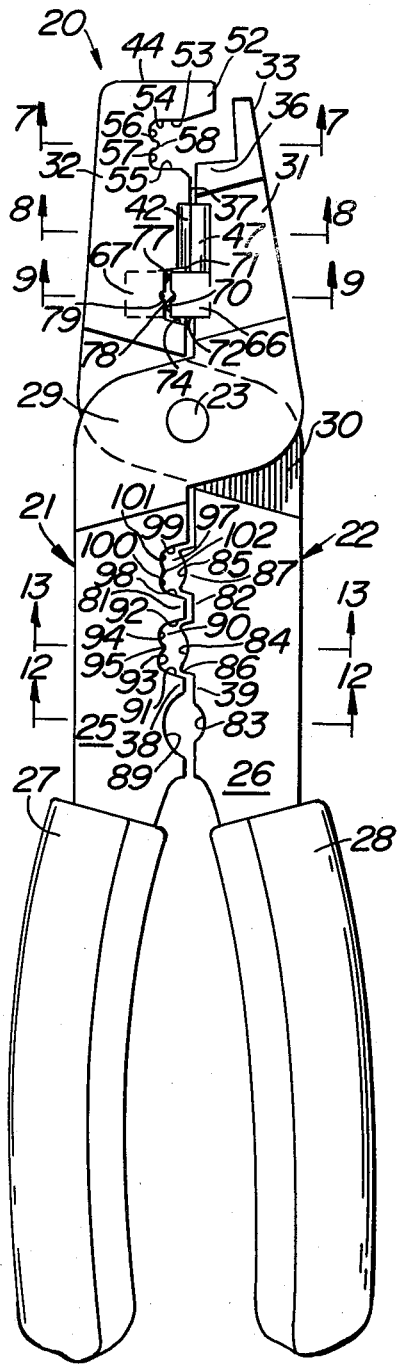
FIG. 1 is a longitudinal view showing one side of a crimping tool of the present invention in a closed condition.
Figure 2:
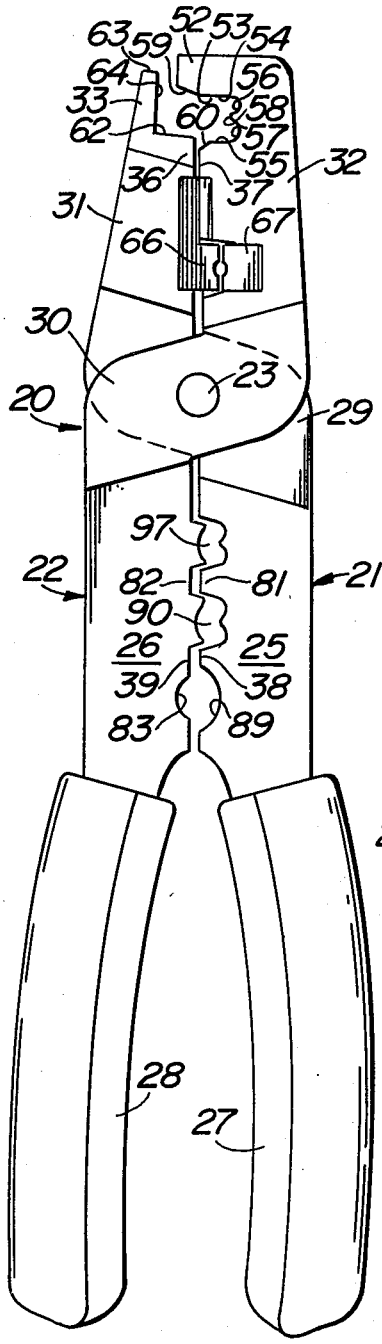
FIG. 2 is a longitudinal view showing the other side of the tool in FIG. 1.
Figure 3:
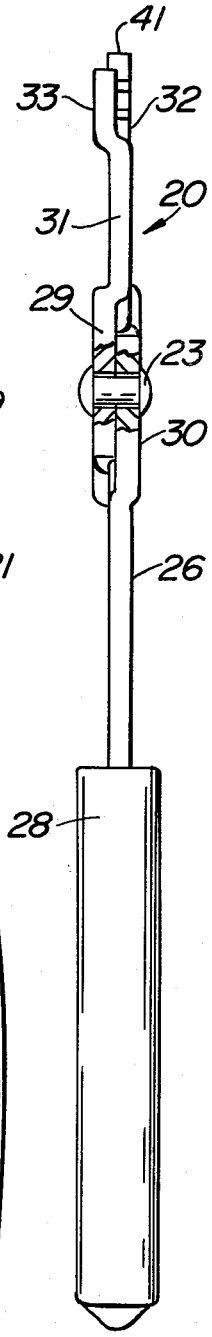
FIG. 3 is a longitudinal edge view taken from the right hand side of FIG. 1, partly broken away.

Referring now more particularly to the drawings, and specifically to FIGS. 1–3 thereof, a tool is there generally designated 20, and is constituted of a pair of crossed levers 21 and 22 pivotally connected together at their crossover region, as by a rivet or pivot 23.

More particularly, the levers 21 and 22 include a pair of elongate, generally straight arms 25 and 26 extending longitudinally of each other away from pivot 23, and each terminating in a longitudinally outwardly extending grip portion or handle, as at 27 and 28, respectively. Extending from the inner ends of arms 25 and 26, in crossing relation with each other are respective offsetting or crossing portions 29 and 30; and from the respective crossing portions generally radially of the pivot 23 and longitudinally of each other and arms 25 and 26 extend lever ends or jaw parts 31 and 32. It will be appreciated that the jaw part 31 is an integral extension of the arm 25, being disposed generally longitudinally thereof and in offset, generally parallel relation with respect thereto, as by the offsetting or crossing portion 29. Similarly, the jaw part 32 extends in generally parallel or longitudinal relation with the arm 26, offset therefrom by the offsetting or crossing portion 30.

Further, while the jaw part 31 is offset laterally from its integral arm 25 by the crossing portion 29, and similarly the jaw part 32 is offset laterally from its arm part 26 by the integral crossing portion 30, each integral jaw part and arm is substantially coplanar, while the connecting crossing regions are offset out of the plane of the connected jaw and arm. That is, arm 25 and jaw part 31 are generally coplanar, and the connecting crossing part 29 is offset out of the plane thereof, as by about half the material thickness. Similarly, the arm 26 and jaw part 32 are generally coplanar and their connecting, crossing part 30 is offset out of the plane by about half the material thickness. Further, the arms 25 and 26 are generally coplanar with each other, as are the jaws 31 and 32; while the connecting or crossing regions 29 and 30 are in facing overlying relation with respect to each other, offset about half the material thickness in opposite directions out of the plane of arms 25 and 26 and jaw parts 31 and 32.

Also, the distal end portion 33 of jaw part 31 is offset and out of the plane of the latter jaw part, generally toward the plane of crossing part 29, as best seen in FIG. 3. Further seen in FIG. 3, the distal end portion, arm or horn 33 is offset out of the plane of jaw part 32, a distance about half the material thickness, for a purpose appearing presently.

The jaw parts 31 and 32 include longitudinally extending adjacent, inner margins or edge portions 36 and 37 swingable toward and away from each other upon pivotal movement of the levers 21 and 22, and being shown in FIGS. 1 and 2 in their proximate conditions of swinging movement. Similarly, the lever parts or arms 25 and 26 include longitudinally extending adjacent, inner margins or edge portions 38 and 39.

Figure 8:
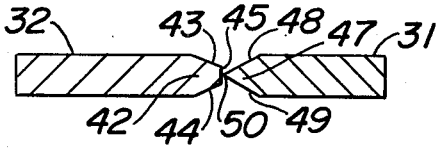
FIG. 8 is a transverse sectional view taken generally along the line 8—8 of FIG. 1.

The inner or adjacent edge portion 37 of jaw part 32, located in spaced relation intermediate the outer or distal end edge 41 of the latter jaw part and pivotal connection 23, is provided with a wire cutoff element or anvil 42 extending longitudinally along the inner portion or edge 37. As best seen in FIG. 8, the anvil 42 is defined between a pair of angularly disposed surfaces 43 and 44 extending longitudinally along the inner portion 37, converging inwardly, toward each other transversely of the jaw part 32 and terminating in a generally flat anvil surface 45 defining an inner edge portion of the jaw part 32, disposed generally normal to the plane thereof.

Opposite to and in facing relation with the anvil 42, located along an intermediate region of inner facing edge portion 36 of jaw part 31 is a cutoff edge 47. The cutoff edge 47 is generally longitudinally coextensive with the anvil 42, and defined between a pair of convergent surfaces 49 extending longitudinally of the jaw part 31 and meeting in a knife edge 50. The knife edge 50 and anvil face 45 meet along a line generally radially of the pivot 33. For purposes of description, the meeting line of cutoff edge 47 with anvil face 45 may be considered as a center line of the tool.

The jaw part 42, flush with its outer end 41 is provided with a transverse projection or tongue 52 extending beyond the tool center line, or the extension of anvil surface 45 radially from pivot 23. Just inward of the extension or tongue 52, and spaced outward of the anvil 42, radially with respect to pivot 23, the facing edge portion 37 of jaw part 32 is formed with a cutout or recess 53. The recess 53 extends into the jaw part 32 between generally parallel outer and inner side walls 54 and 55, and terminates in an inner end or recess bottom wall constituted of a pair of generally semi-circular notches or troughs 56 and 57 being respectively smooth extensions from the side walls 54 and 55 and meeting at an intermediate crest 58. The recess side wall 54 extends outwardly to the end of extension or tongue 52, being provided therealong with a bevel or chamfer 59, of approximately 30°. The side wall 55 is similarly bevelled or chamfered, as at 60, at an angle of about 30° adjacent to the facing jaw part portion 37.

Directly opposite to the cutout or recess 53 of jaw part 32, the inner or facing portion 36 of jaw part 31 is cut away, as at 62, to define the generally radially projecting arm or horn 33. As best seen in FIGS. 1 and 2, the projecting arm or horn 33 may be of a somewhat tapering configuration toward its outer end 63, and may have its inner longitudinal side or edge 64 in general parallelism with a line tangent to both troughs 56 and 57 when the jaw parts are in their fully closed position of FIGS. 1 and 2. In practice, it has been found advantageous in manufacture to form the arm or horn 33 with its inner side or edge 64 generally convergent with the cutoff knife edge 50, upon extension of the same longitudinally outwardly beyond the tool.

The cutout or recess 53 combines with the arm or horn 33 to provide a high tower crimping station, as will appear more fully hereinafter. Also, the cutoff edge 47 and anvil 42 combine to define a wire cut-off station.

Figure 9:
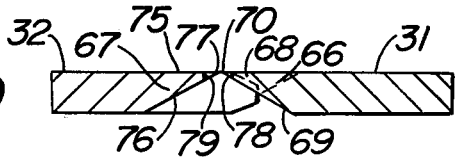
FIG. 9 is a transverse sectional view taken generally along the line 9—9 of FIG. 1.

Just radially inward of the wire cut-off station 42, 47, there are provided on the adjacent arm portions 36 and 37 a pair of knife edges 66 and 67. In particular, the knife edge 66 is generally flush or coplanar, as at 68, on one side with the surrounding surface of jaw part 31, see FIG. 9. The knife edge 66 is contiguous to the cutoff edge 47 and extends beyond the latter and beyond the hereinbefore defined center line of the tool, as seen in FIGS. 1 and 2. On the other side of jaw part 31, the knife edge 66 is bevelled, as at 69 to meet the surface 68 in a cutting edge 70. The cutting edge 70 may extend generally parallel to the cutting edge 50 of cutoff knife 47, but is spaced therefrom outwardly of the jaw part 31. Specifically, the knife edge 66 extends beyond the tool center line and cutoff edge 50, as between a side edge 71 at the adjacent end of cutoff edge 47, and a side edge 72 parallel to and spaced inward from the side edge 71 radially of the pivot 23.

The complementary knife edge 67 is recessed into its jaw part 32, spaced inward from the tool center line, as by a cutout 74 formed in the jaw part facing edge 37. The cutout 74 receives the projecting knife edge 66. The recessed knife edge 67 has one surface 75 flush with the adjacent surface of jaw part 32, and also flush with the surface 68 of knife edge 66. On the other side of jaw part 32, the knife edge 67 is formed with a bevelled surface 76 tapering toward the surface 75 and meeting with the latter at a cutting edge 77 extending in adjacent, parallel, spaced relation with the cutting edge 70 of the knife edge 66. Thus, the cutting edges 70 and 77 are movable toward each other in a cooperative shearing relation for cutting insulation of wire interposed between the edges. Medially of the edges 70 and 77, there are formed therein respective, facing arcuate notches 78 and 79. The adjacent facing notches are located to receive a wire core or conductor, being spacedly received therebetween and the notches being non-cutting, so as to effectively prevent damage to the core.

In particular, the recessed knife edge 67, as by its cutout 74, is adapted to receive a wire end portion to be stripped of insulation when the jaw parts 31 and 32 are spaced apart or opened. Upon closure of the jaw parts, the cooperating cutting edges 70 and 77 cut the wire insulation without cutting the central conductor. By the spacing between edges 70 and 77 at their closest points, there is left a small portion or tag of the wire insulator, which can be readily severed by manual pulling, or by slight rotation of the wire in the recess 74 and an additional closure of the jaws.

Prior to wire stripping, the wire may be cut to desired length, as by location between the cutoff edge 47 and anvil 42. Such location is greatly facilitated by the projection of knife edge 66 beyond the cutoff edge 47. That is, upon opening of the jaw parts 31 and 32 to receive a wire to be cut-off, the wire may be conveniently dropped between the jaw parts until resting on the exposed side edge 71 of knife edge 66. Mere closing of the jaws will then effect severance of the wire.

To facilitate manufacture and reduce costs, the jaw parts 31 and 32 may be die formed, except for the anvil surfaces 43 and 44, cutoff edge surfaces 48 and 49, and stripper knife surfaces 69 and 76. Further, stripper knife surface 69 may be a flush continuation of cutoff edge surface 49, to further reduce required machining. The wire core receiving notches 78 and 79 may be formed in the stamping, so as to require no further forming operations.

The lever parts or arms 25 and 26 include adjacent inner edge margins or portions 81 and 82. Along the lever portion 82, in adjacent spaced relation, are a plurality of generally arcuate or concave recesses, as at 83, 84 and 85. The recesses 83–85 are for receiving the bends or bight regions of generally U-shaped wire terminals, as will appear more fully hereinafter. The bight receiving recess 83 may be furthest from the pivot 23, and cut out of the edge portion 82. The bight receiving recess 84 may be adjacent to and spaced inwardly from the recess 83 toward the pivot 23, and similarly the bight receiving recess 85 may be adjacent to and spaced inwardly from the recesses 84 toward the pivot 23. Further, the bight receiving recesses 84 and 85 may be formed in lugs or projections 86 and 87 outstanding from the lever edge portion 39.

Opposite to and in facing relation with the bight receiving recess 83, formed in the facing portion 38 of lever arm 25 may be an initial forming recess 89, which may be generally arcuately concave, say generally semi-circular and larger than its facing recess 83.

Adjacent to the initial forming recess 89, spaced therefrom along the facing portion 38 toward pivot 23, is a final forming recess 90 cutout of the lever arm 25, being defined between a pair of inwardly convergent side walls 91 and 92, and a bottom wall defined by a pair of side by side concavely arcuate edges or troughs 93 and 94 meeting in a medial crest or cusp 95. Thus, the side walls 91 and 92 merge smoothly into respective troughs 93 and 94 which meet at medial cusp 95.

Opposite to the radially innermost bight receiving recess 85, the facing edge margin or portion 81 of lever arm 25 is cut away to form an additional final forming recess 97. The recess 97 is slightly smaller in proportions than the recess 90, for final forming operations with wire of slightly smaller size. More particularly, the final forming recess 97 is defined within a pair of inwardly convergent side walls 98 and 99, which merge respectively into a pair of arcuate concave troughs 100 and 101, which in turn meet at a crest or cusp 102.

The operation of the first bight recess 83 and its oppositely disposed initial forming recess 89 is shown in FIG. 10, wherein a generally U-shaped wire terminal 105 includes a bight portion 106 from opposite ends of which extend a pair of legs 107 and 108. With a wire 109 received in the terminal 105, and the terminal bight 106 engaged in bight receiving recess 38, the legs 107 and 108 extend into initial forming recess 89. Upon movement of levers or arms 25 and 26 toward each other, the legs 107 and 108 are caused to begin turning inwardly about wire 109, an initial forming operation.

Subsequently, the initially formed terminal 105 and its received wire 109 are arranged, according to wire size with the terminal bight 106 received in the appropriate bight receiving recess 85, 84. The partially inturned legs 107 and 108 from the initially formed configuration of FIG. 10 are guided by the side walls 91 and 92 of recess 90, and thence by troughs 100 and 101 to effect inturning and full crimping of the terminal 105 about the wire 109 upon movement of lever arms 25 and 26 toward each other.

While the bight receiving recess 83 and its initial forming recess 89 are capable of operation with different sizes of wire and terminals of varying shapes, the full final forming and crimping is preferably achieved at the bight receiving recess and final forming recess corresponding to the wire size.

Figure 5:
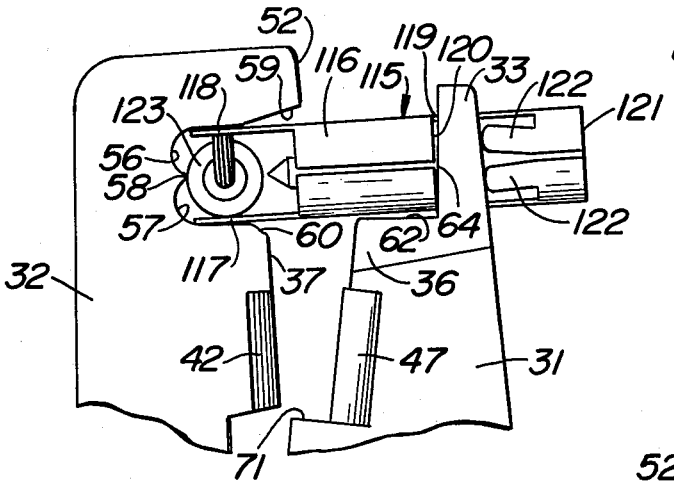
FIG. 5 is a partial side elevational view similar to FIG. 4, but showing an intermediate stage of high tower terminal crimping operation.
Figure 6:
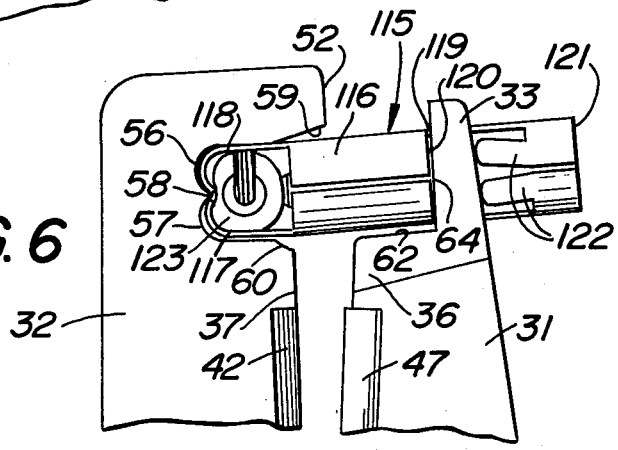
FIG. 6 is a partial side view showing a final stage in the high tower terminal crimping procedure.
Figure 7:
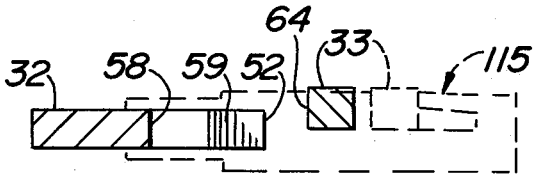
FIG. 7 is a transverse sectional view taken generally along the line 7—7 of FIG. 1, and showing in phantom an intermediate high tower terminal crimping position, as illustrated in FIG. 5.

The hereinbefore described recess 52 of jaw part 32 and cooperating arm or horn 33 are specifically configured for use with high tower wire terminals, such as employed in distributor caps. A high tower terminal is shown in FIGS. 4–6, in successive stages of connection to a wire. The high tower terminal may be generally designated 115, including a tubular main body 116 having a pair of longitudinally outwardly extending legs 117 and 118. The tubular part may be generally chordally cut away, as at 119 to leave a transverse shoulder 120 facing generally toward the terminal end 121 remote from the legs. Further, resilient arms or leafs 122 may be formed in the tubular terminal part for snug frictional engagement in a distributor tower.

Initially, the arm or horn 33 may enter sidewise into the chordal opening 119 of terminal 115, and lightly frictionally retained therein, as by the tapering configuration of horn 33 wedging into the chordal opening. Further, the jaws 31 and 32 are closed to a position with the legs 117 and 118 in frictional bearing engagement with respective inclined or beveled surfaces 60 and 59. By the pivotal connection 23, the tool levers 21 and 22 are self-holding in any selected position of their relative angular movement; and further, by the frictional engagement of horn or arm 33 in the chordal opening 119 of terminal 115, and further frictional engagement of legs 117 and 118 with respective surfaces 60 and 59, the terminal and tool are self-maintaining in position. Thus, an operator may hold only a single handle 27, 28 with one hand, and with the other hand insert an end portion of wire into the recess or cut out 53.

The jaw parts 31 and 32 may be moved toward each other to the position shown in FIG. 5, and further moved toward each other to the position shown in FIG. 6, wherein the legs 117 and 118 are fully crimped about the wire 123, as effected by the double trough configuration of the recess 53. The wire and firmly electrically and mechanically connected terminal 115 may then be removed from the tool for satisfactory use as required.

From the foregoing, it is seen that the present invention provides a plier type crimping tool for applying terminals to automotive ignition wire, which is well adapted to perform all necessary wire cutting, stripping and crimping operations for different wire sizes and terminal types, is capable of manufacture at considerable savings in costs, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A crimping tool for automotive ignition terminals and the like, said tool comprising: a pair of pivotally connected levers, a cut-off edge on one lever adjacent to the other lever, an anvil on the other lever facing toward said cut-off edge for abutting engagement therewith to sever a wire, a pair of insulation stripping knife edges on said levers for cutting engagement with insulation of an interposed wire, one of said knife edges extending beyond the adjacent portion of its lever and the other of said knife edges being recessed into its lever for receiving one knife edge when said knife edges are in said limiting position, said knife edges extending toward and terminating short of each other in a limiting position with said anvil and cut-off edge abutting to leave an unsevered insulation tag, and said knife edges having facing notches for receiving a wire core without severance.

2. A crimping tool according to claim 1, said one knife edge being on said one lever, said other knife edge being on said other lever, and said cut-off edge having one face flush with one face of said one knife edge.

3. A crimping tool according to claim 1, in combination with a generally radial arm on one of said levers for carrying a high tower terminal, the remaining lever having a recess facing said arm with a bottom wall configured to crimp a high tower terminal carried by said arm upon movement thereof into said recess.

4. A crimping tool according to claim 3, said recess bottom wall having a pair of adjacent troughs for receiving and crimping a pair of end tabs of a high tower terminal.

5. A crimping tool according to claim 3, said arm having a bearing surface facing toward said recess for bearing engagement with a transverse edge of a high tower terminal, said arm bearing surface being oriented with respect to said recess to move into general parallelism with said recess bottom wall in a full crimping position of said levers.

6. A crimping tool according to claim 5, said recess having an inwardly convergent mouth for frictional guiding engagement with a pair of end tabs of a high tower terminal.

7. A crimping tool according to claim 6, said pivotally connected levers being self-retaining in a selected position of pivotal movement, for holding a high tower terminal in position between said arm bearing surface and recess mouth for insertion of a wire through said recess.

8. A crimping tool according to claim 3, said certain lever having one end portion offset from the next adjacent portion, said one end portion of said lever including said arm for locating the latter offset from said recess.

9. A crimping tool according to claim 1, said knife edges being located adjacent to said cut-off edge and anvil, toward the lever pivotal axis said one knife edge providing a stop for wire positioning between said cut-off edge and anvil.

10. In a crimping tool for automotive ignition terminals and the like, the combination comprising: a pair of pivotally connected levers, a pair of facing portions on said levers and movable toward and away from each other, a first bight recess in a facing portion for receiving the bight of a generally U-shaped wire terminal, an initial forming recess in a facing portion opposite to and larger than said first bight recess for receiving and partially inturning the legs of a wire terminal, said initial forming recess being relatively large for operation with terminals of different sizes and various shapes, a second bight recess in a facing portion for receiving the bight of a wire terminal having partially inturned legs, a third bight recess in a facing portion for receiving the bight of a wire terminal having partially inturned legs, a final forming recess in a facing portion opposite to said second bight recess and having a pair of troughs for final forming of terminal legs crimped about a wire and an additional final forming recess in a facing portion opposite to said third bight recess and having an additional pair of troughs for final forming of terminal legs crimped about a wire, said second bight recess and final forming recess being specifically configured to fully crimp a terminal about a certain size wire and said third bight recess and additional final forming recess being specifically configured to fully crimp a terminal about a different wire size.

11. A crimping tool according to claim 10, said first, second and third bight recesses being located on one facing portion in side by side adjacent spaced relation with each other; and said initial, final and additional final forming recesses being located on the other facing portion opposite to said one facing portion.

12. A crimping tool according to claim 10, said first bight and initial forming recesses being spaced from the lever pivotal axis further than the remaining of said recesses.

13. A crimping tool according to claim 10, said third and additional final forming recesses being specifically configured to fully crimp a terminal about a smaller wire than said second bight and final forming recesses and being located closer to the lever pivotal axis than said second bight and final forming recesses.

14. A crimping tool for automotive ignition terminals and the like, said tool comprising: a pair of pivotally connected levers, a cut-off edge on one lever adjacent to the other lever, an anvil on the other lever facing toward said cut-off edge for abutting engagement therewith to sever a wire, a pair of insulation stripping knife edges on said levers for cutting engagement with insulation of an interposed wire, said knife edges extending toward and terminatng short of each other in a limiting position with said anvil and cut-off edge abutting to leave an unsevered insulation tag and having facing notches for receiving a wire core without severance, a generally radial arm on a certain of said levers for carrying a high tower terminal, the remaining lever having a recess facing said arm with a bottom wall configured to crimp a high tower terminal carried by said arm upon movement thereof into said recess and an inwardly convergent mouth defined by corner bevels on opposite sides of said recess for frictional guiding engagement with a pair of end tabs of a high tower terminal, said radial arm having a bearing surface facing toward said recess for bearing engagement with a transverse edge of a high tower terminal, said arm bearing surface being oriented with respect to said recess to move into general parallelism with said recess bottom wall in a full crimping position of said levers.

15. A crimping tool according to claim 14, said recess having its opposite side walls extending respectively from said bevels in general parallelism with each other to said recess bottom wall.

16. A crimping tool according to claim 15, said recess bottom wall having a pair of adjacent troughs for receiving and crimping a pair of end tabs of a high tower terminal, said recess side walls merging smoothly with the distal sides of respective troughs.

* * * * *